US007168404B2

(12) United States Patent
Murata

(10) Patent No.: US 7,168,404 B2
(45) Date of Patent: Jan. 30, 2007

(54) VARIABLE VALVE APPARATUS OF INTERNAL COMBUSTION ENGINE

(75) Inventor: Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/448,819

(22) Filed: Jun. 8, 2006

(65) Prior Publication Data

US 2006/0278186 A1 Dec. 14, 2006

(30) Foreign Application Priority Data

Jun. 9, 2005 (JP) ..... 2005-169635

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.2, 90.39, 90.44; 74/559, 567, 569
See application file for complete search history.

(56) References Cited

U.S. PATENT DOCUMENTS 6,425,357 B1 * 7/2002 Shimizu et al. ..... 123/90.16
6,994,063 B1 * 2/2006 Murata ..... 123/90.16

FOREIGN PATENT DOCUMENTS

JP 2003-239712 A 8/2003

* cited by examiner

*Primary Examiner*—Ching Chang
(74) *Attorney, Agent, or Firm*—Birch, Stewart, Kolasch & Birch, LLP

(57) ABSTRACT

A variable valve apparatus is employed a configuration in which, at a high valve lift and high speed operation of an internal combustion engine, an oscillating fulcrum of a transmission arm and a rotation center of a control shaft are arranged between a direction of a component rotating a control shaft of a maximum load which occurs in the oscillating fulcrum of the transmission arm when an oscillating cam oscillates in a valve opening direction and a direction of a component rotating a control shaft of a maximum load opposite thereto which occurs when the oscillating cam oscillates in a valve closing direction.

6 Claims, 13 Drawing Sheets

VARIABLE VALVE APPARATUS OF INTERNAL COMBUSTION ENGINE

BACKGROUND OF THE INVENTION

1. Field of the Invention

The present invention relates to a variable valve apparatus of an internal combustion engine, which varies the phase of an intake valve or an exhaust valve.

2. Description of the Related Art

Many reciprocating engines mounted in automobiles include a variable valve apparatus for changing the phases of an intake valve and an exhaust valve, for reasons of engine gas emission countermeasures, fuel consumption reduction and the like.

Many of such variable valve apparatuses employ a structure in which the phase of a cam formed on a camshaft is replaced with an oscillating cam in which a base circular zone and a lift zone are ranging. Specifically, a structure is employed in which an oscillating range of the oscillating cam is changed, whereby a valve opening period and a valve lift amount of the intake valve and the exhaust valve driven via a rocker arm are varied continuously.

In order to improve a pumping loss, a structure is proposed in Jpn. Pat. Appln. KOKAI Publication No. 2003-239712 in which a transmission arm is interposed between a cam and an oscillating cam, and the transmission arm is oscillatably supported by a control shaft.

Specifically, the transmission arm is moved by the turning displacement of the control shaft. A contact position of transmission arm and the cam is changed by moving the transmission arm. By changing the contact position of the transmission arm and the cam, the valve characteristics, that is, a valve opening period, valve open-close timing and a valve lift volume are continuously varied.

In such a variable valve apparatus, it is known that, when an engine is operated at a high valve lift and at a high speed, a force for driving an intake valve or an exhaust valve becomes large by a positive acceleration zone of a cam lift just after opening the valve and just before closing the valve.

As disclosed in Jpn. Pat. Appln. KOKAI Publication No. 2003-239712, in most variable valve apparatuses using a transmission arm, a valve driving force at opening the valve, and a reaction force working onto a contact point portion of an oscillating cam and a contact point portion of a cam at closing the valve are applied to an oscillating fulcrum of the transmission arm in a same direction at the high valve lift and high speed operation.

In the structure in which the resultant force of these forces works on the oscillating fulcrum, a load amount to be added is large. Therefore, when the force for driving the valve becomes large and the like, an excessive load is likely to work on the oscillating fulcrum of the transmission arm.

In particular, when an excessive load works on the control shaft, there occurs a deformation under torsion in the control shaft. Therefore, there is a fear that preset valve characteristics, that is, valve lift amount and the like may not be reproduced. Further, an actuator having a large capacity and a large size enough to generate a torque to overcome an excessive torque is required.

In particular, in the case of a multicylinder engine in which valve characteristics of each cylinder are varied by a common control shaft, the influence of the deformation under torsion of the control shaft tends to become larger in the cylinders away from the actuator in comparison with the cylinders near the actuator that turns the control shaft.

Therefore, in the multicylinder engines, there occur differences in the valve lift amount and the valve opening period among the cylinders, and there occur differences in the combustion conditions among the cylinders, which causes vibration in the engine, degrades the output, and degrades the fuel consumption.

Under such circumferences, in these variable valve apparatuses, countermeasures must be taken by use of a strong oscillating fulcrum durable to an excessive load and a highly rigid control shaft.

However, these countermeasures make the structure of the variable valve apparatus complicated, and additionally make the structure around the control shaft including the control shaft large.

BRIEF SUMMARY OF THE INVENTION

Accordingly, an object of the present invention is to provide a variable valve apparatus of an internal combustion engine of a simple and compact structure, in which a load working on an oscillating fulcrum of transmission shaft is suppressed at a high valve lift and high speed operation.

In order to achieve the above object, according to one aspect of the present invention, there is employed a configuration in which, at a high valve lift and high speed operation of an internal combustion engine, an oscillating fulcrum of a transmission arm and a rotation center of a control shaft are arranged between a direction of a component rotating a control shaft of a maximum load which occurs in the oscillating fulcrum of the transmission arm when an oscillating cam oscillates in a valve opening direction and a direction of a component rotating a control shaft of a maximum load opposite thereto which occurs when the oscillating cam oscillates in a valve closing direction.

In this structure, at the high valve lift and high speed operation, the rotation center of the control shaft and the oscillating fulcrum of the transmission arm are arranged between a direction of a component rotating the control shaft of a load which occurs in the oscillating fulcrum of the transmission arm when the oscillating cam oscillates in a valve opening direction and a direction a component rotating the control shaft of a load opposite thereto which occurs when the oscillating cam oscillates in a valve closing direction. Consequently, at the operation, the resultant force of the valve driving force and the reaction force thereof in the prior art does not work onto the oscillating fulcrum of the transmission arm, but any one load of the forces works alternately.

Accordingly, by a simple arrangement and structure of the oscillating fulcrum of the transmission arm and the control shaft, it is possible to prevent an excessive load in the rotation direction of the control shaft from working onto the oscillating fulcrum of the transmission arm at the high left and high speed operation. Thereby, it is possible to prevent an excessive torque from occurring in the control shaft at the high valve lift and high speed operation.

As a result, it is possible to suppress the burden working onto the oscillating fulcrum of the transmission arm and the control shaft, and further, it is possible to make compact the peripheral area of the control shaft including the control shaft. Furthermore, it is possible to make compact the actuator for operating the control shaft. In addition, the deformation under torsion occurring in the control shaft is suppressed, and accordingly, it is possible to reproduce preset valve characteristics. Consequently, the output of an internal combustion engine and the fuel consumption are improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A variable valve apparatus according to a first embodiment of the present invention will be explained with reference to FIGS. 1 to 11 hereinafter.

Figure 1:
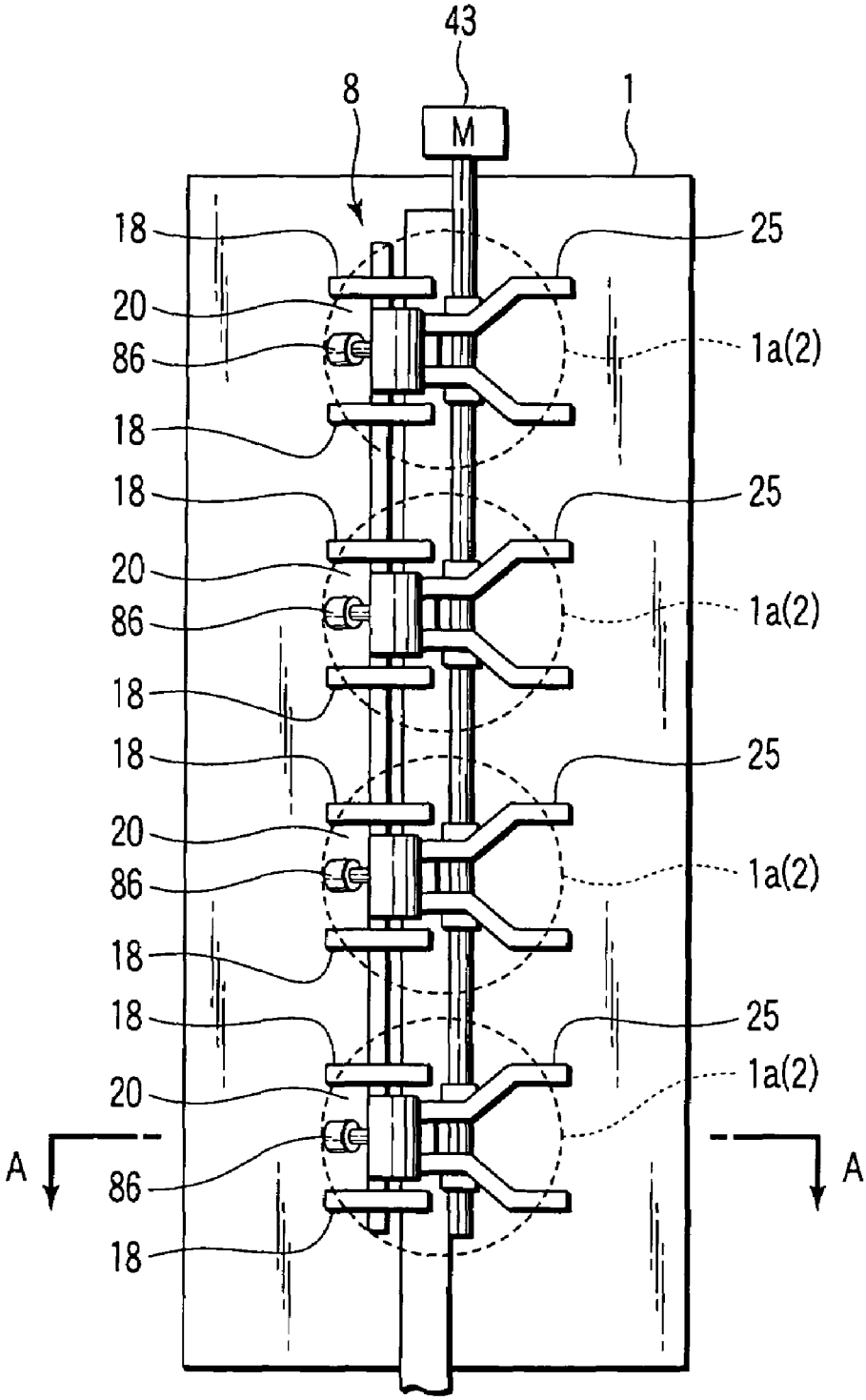
FIG. 1 is a plan view showing a cylinder head having mounted thereon a variable valve apparatus according to a first embodiment of the present invention.
Figure 2:
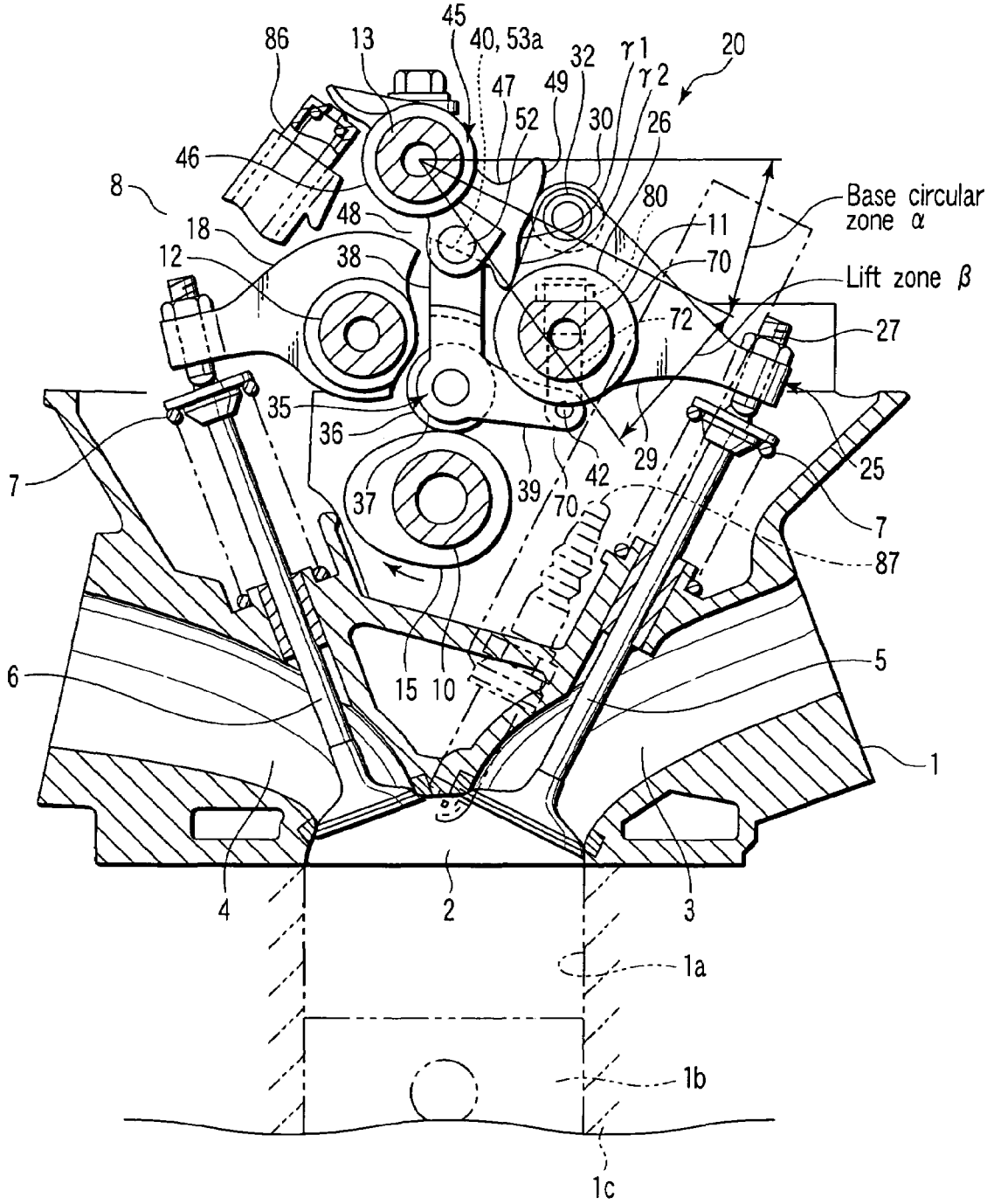
FIG. 2 is a cross sectional view showing the variable valve apparatus and the cylinder head taken along line A—A in FIG. 1.
Figure 3:
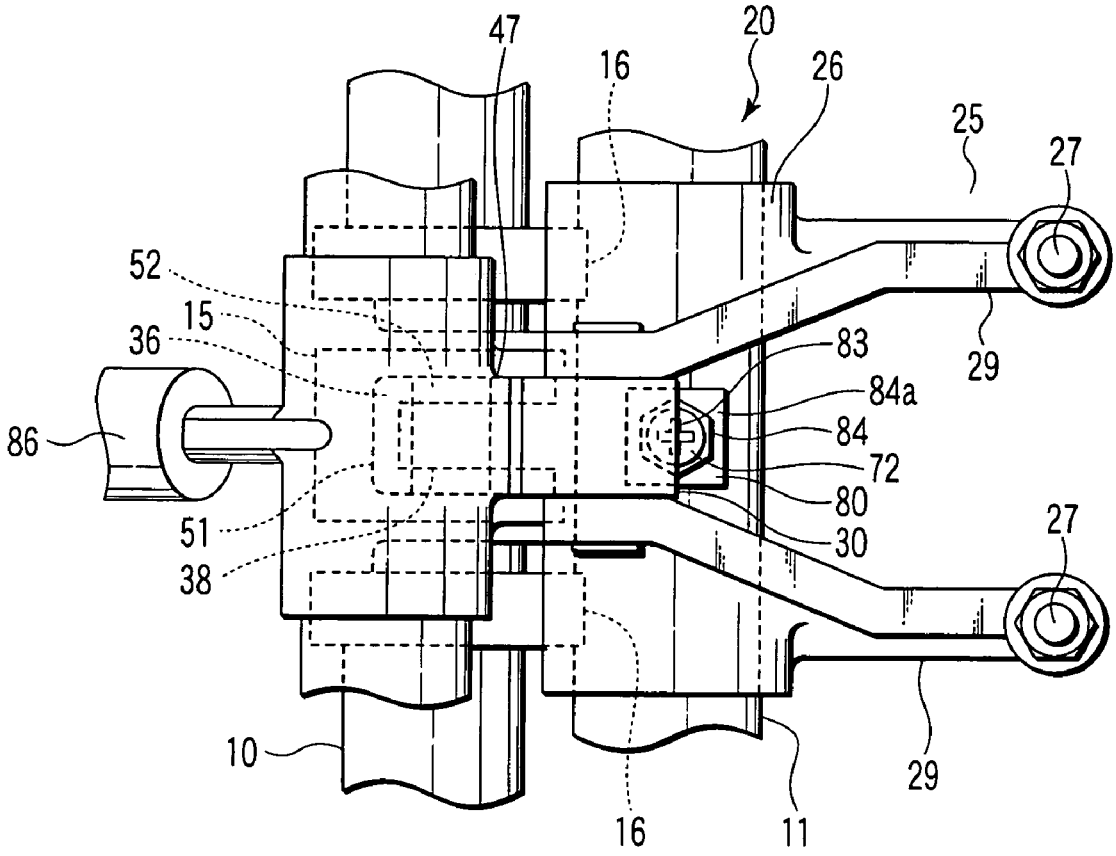
FIG. 3 is a plan view showing the variable valve apparatus shown in FIG. 2.
Figure 4:
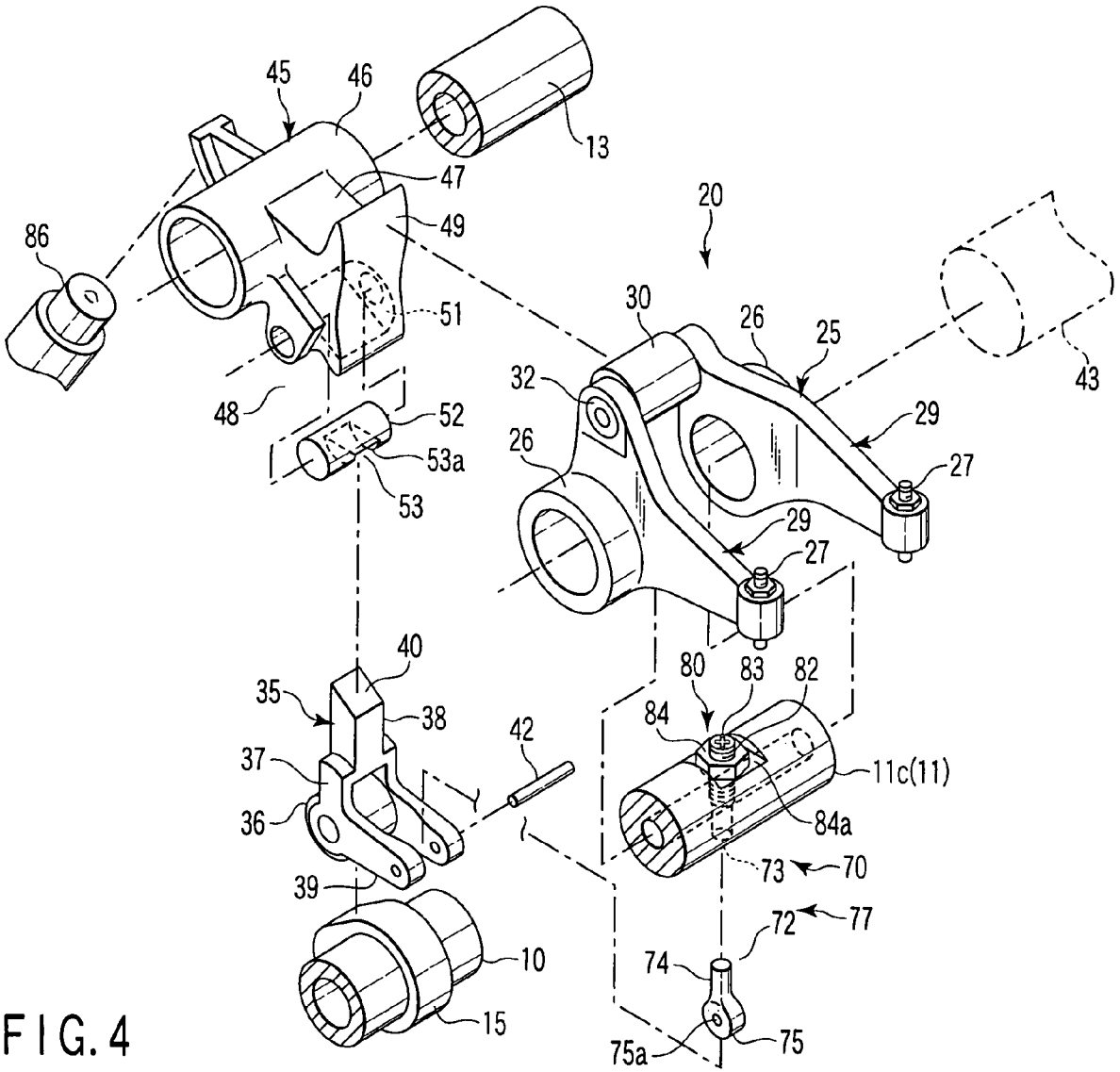
FIG. 4 is an exploded perspective view showing the variable valve apparatus shown in FIG. 2.

FIG. 1 is a plan view of a cylinder head 1 of a multi-cylinder internal combustion engine, for example, a 4-cylinder reciprocating gasoline engine 100 with cylinders 1*a* arranged in series. FIG. 2 is a detailed cross sectional view of the cylinder head 1 taken along line A—A shown in FIG. 1. FIG. 3 is a plan view showing a part of the cylinder head 1 enlarged. FIG. 4 is an exploded view of a variable valve apparatus 20 mounted on the cylinder head 1.

The cylinder head 1 will be explained with reference to FIGS. 1 to 3. On a lower surface of the cylinder head 1, combustion chambers 2 are formed, respectively, in the wake of four cylinders 1*a* formed in a cylinder block 1*c* and arranged in series. Note that combustion chamber 2 is illustrated only one in the figure.

For example, two pieces each of intake port 3 and exhaust port 4, that is, one pair of intake port 3 and exhaust port 4 are formed in the combustion chambers 2. An intake valve 5 that opens and closes the intake port 3 and an exhaust valve 6 that opens and closes the exhaust port 4 are assembled on the top of the cylinder head 1. For the intake valve 5 and the exhaust valve 6, a normally closed reciprocating valve which is energized in the closing direction by a valve spring 7 is used, respectively. Note that a piston 1*b* is reciprocatively housed in the cylinder 1*a*. The piston 1*b* is illustrated by chain two-dot, dashed line in FIG. 2.

In FIGS. 1 and 2, reference numeral 8 denotes, for example, a Single Overhead Camshaft (SOHC) type valve operating system mounted to the upper part of the cylinder head 1. The valve operating system 8 drives the intake valve 5 and exhaust valve 6.

Reference numeral 10 denotes a camshaft rotatably arranged in the longitudinal direction of the cylinder head 1 on the top of the combustion chamber 2. Reference numeral 11 denotes a rocker shaft on the intake side rotatably arranged in intake port side with which the camshaft 10 is sandwiched. The rocker shaft 11 is also used as a control shaft of the present application.

Reference numeral 12 is a rocker shaft on the exhaust side arranged and fixed on the exhaust port side. Reference numeral 13 denotes a support shaft lying above the rocker shaft 11 and 12 and located closer to the rocker shaft 12 than to the rocker shaft 11. Rocker shafts 11 and 12 and the support shaft 13 are all configured by shaft members arranged in parallel to the camshaft 10.

The camshaft 10 is rotatably driven along the arrow-mark direction of FIG. 2 by an output from a crankshaft of the engine. Note that the crankshaft is not shown. To each part of the camshaft 10, an intake cam 15 and two exhaust cams 16 are formed for each combustion chamber 2, that is, for each cylinder. The intake cam 15 is corresponding to the cam of the present invention. The intake cam 15 is arranged at the overhead center of the combustion chamber 2. The exhaust cams 16 and 16 are arranged on both sides of the intake cam 15, respectively.

To the exhaust-side rocker shaft 12, a rocker arm 18 for exhaust valve is rotatably supported for each exhaust cam 16, that is, each exhaust valve 6 as shown in FIGS. 1 and 2. In addition, to the intake side rocker shaft 11, a variable valve apparatus 20 is assembled for each pair of intake cams 15, that is, for each pair of intake valves.

The rocker arm 18 transmits displacement of the exhaust cam 16 to the exhaust valve 6. The variable valve apparatus 20 transmits displacement of the intake cam 15 to the intake valves 5 and 5. Due to the rocker arm 18 and the variable valve apparatus 20 being driven by each cam 15 and 16, predetermined combustion cycles, for example, four strokes of intake stroke, compression stroke, explosion stroke and exhaust stroke, are formed in the cylinder 1*a* in linkage with the reciprocating motion of the piston 1*b*. Note that reference numeral 87 in FIG. 2 denotes an ignition plug to ignite fuel-air mixture in the combustion chamber 2.

To explain the variable valve apparatus 20, as shown in FIGS. 1 to 4, the apparatus 20 comprise a rocker arm 25, center rocker arm 35, a swing arm 45 and a support mechanism 70. The rocker arm 25 is oscillatably supported by the rocker shaft.

The swing cam 45 is combined with the rocker arm 25. The swing cam 45 is equivalent to the oscillating cam of the present invention.

The center rocker arm 35 transmits displacement of the intake cam 15 to the swing cam 45. The center rocker arm 35 is equivalent to the transmission arm of the present invention. The support mechanism 70 oscillatably supports the center rocker arm 35 to the rocker arm 11.

As shown in FIGS. 3 and 4, the rocker arm 25 is, for example, bifurcate. Specifically the rocker arm 25 has a pair of rocker shaft arm pieces 29 and a roller member 30. A cylindrical rocker shaft supporting boss 26 is formed at the center of the each rocker arm piece 29.

To one side of the each rocker arm piece 29, adjust screw unit 27 which drives the intake valve is assembled. The roller member 30 is sandwiched between other ends of the rocker arm pieces 29. The roller member 30 is a contact unit of the present invention.

Note that reference numeral 32 denotes a short shaft to rotatably pivot the roller member 30 to the rocker arm piece 29. The rocker shaft 11 is inserted in the bosses 26 and can oscillate. The roller member 30 is arranged on the support shaft 13 side, namely on the center side of the cylinder head 1.

The adjust screw units 27 are arranged at the upper ends of the intake valves 5, that is, valve stem end of the intake valve 5, respectively. When the rocker arm 25 oscillates around the rocker shaft 11, the intake valves 5 are driven.

As shown in FIGS. 2 to 4, the swing cam 45 has a boss portion 46, an arm portion 47, and a receiving unit 48. The boss portion 46 is cylindrical. The support shaft 13 is inserted into the boss portion and rotatably fitted.

The arm portion 47 extends from the boss portion 46 to the roller member 30, that is, rocker shaft. The receiving unit 48 is formed at the lower part of the arm portion 47.

The front end surface of the arm portion 47 is a cam surface 49 which transmits displacement to the rocker arm 25. The cam surface 49 extends in the vertical direction. The cam surface 49 is brought rotatably in contact with the outer circumferential surface of the roller member 30 of the rocker arm 25. The detail of the cam surface 49 will be described later.

As shown in FIG. 4, the receiving unit 48 comprises a recessed portion 51 and a short shaft 52. The recessed portion 51 is formed at the lower surface portion of the lower part of the arm portion 47 which is directly above the camshaft 10.

The short shaft 52 is rotatably supported in the recessed portion 51 in the direction same as that of the camshaft 10.

Note that reference numeral 53 denotes a recessed portion which is formed on the outer circumference of the short shaft 52 portion and has a flat bottom surface.

As shown in FIGS. 2 and 4, to the center rocker arm 35, a substantially L-shape member is used. The center rocker arm 35 has a rotary contact element, for example, a cam follower 36 which comes rotatably in contact with the cam surface of the intake cam 15, and frame-shape holder unit 37 which rotatably supports the cam follower 36.

Specifically, the center rocker arm 35 has a relay arm portion 38 and a fulcrum arm portion 39. The relay arm portion 38 extends from the holder unit 37 towards between the upper rocker shaft 11 and the support shaft 13.

As shown in FIGS. 5 to 8, the fulcrum arm portion 39 extends from the holder unit 37 to the bottom side of a shaft portion 11*c* of the rocker shaft 11. The shaft portion 11*c* is exposed from between the pair of rocker arm pieces 29. The fulcrum arm portion 39 is, for example, bifurcated.

To the front end, i.e. top end surface, of the relay arm portion 38, a gradient surface 40 is formed as a drive surface. The gradient surface 40 tilts in such a manner that the rocker shaft 11 side is lower and the support shaft 13 side is higher. The front end of the relay arm portion 38 is inserted into the recessed portion 53 of the swing cam 45. With this, the center rocker arm 35 is interposed between the intake cam 15 and the swing cam 45. The gradient surface 40 of the arm unit 38 is slidably abutted on a receiving surface 53*a* formed at the bottom surface of the recessed portion 53. By this, displacement of the intake cam 15 is transmitted to the swing cam 45 from the relay arm portion 38 while being accompanied by slides.

As shown in FIGS. 2 and 4, the support mechanism 70 has a support unit 77 and an adjusting unit 80. The support unit 77 has a control arm 72. The control arm 72 oscillatably supports the center rocker arm 35. The adjusting unit 80 adjust the position of the center rocker arm 35.

Now, the support unit 77 will be explained. A through hole 73 is formed on a lower peripheral wall of the shaft portion 11*c*. The through hole portion 11 extends in a direction orthogonal to the center of axle of the shaft portion 11*c*. The control arm 72 is formed to have a rod portion 74 having a circular cross section, a disk-shaped pin joining piece 75 formed on one end of the rod portion 74, and a support hole 75*a* formed on the pin joining piece 75.

The support hole 75*a* is shown in FIG. 4. The end of the shaft 74 is inserted into the through hole 73 from the bottom of the shaft portion 11*c*. Note that the inserted rod portion 74 can move in the axial direction and rotate in the circumferential direction. The end of the rod portion 74 impinges against a component of the adjusting unit 80 described later.

The pin joining piece 75 is inserted in the fulcrum arm portion 39. A pin 42 is inserted in the arm unit 39 and the support hole 75*a*, thereby allowing the front end of the fulcrum arm portion 39 and the end of the control arm 72 protruding from the shaft portion 11*c* to rotatably join each other in the protruding direction, that is, direction orthogonal to the center of axle of the camshaft 10 of the intake cam 15.

Since the fulcrum arm portion 39 and the control arm 72 are joined together, the center rocker arm 35 oscillates up and down, using the pin 42 as fulcrum, when the in the intake cam 15. In linkage with the motion of the center rocker arm 35, the swing cam 45 is periodically oscillated with the support shaft 13 used as the fulcrum, the short shaft 52 used as the point of action, that is, point at which a load from the center rocker arm 35 works on, and the cam surface 49 used as the point of force, that is, as point at which the rocker arm 25 is driven.

Note that the rocker arm 25, the center rocker arm 35, and the swing cam 45 are mutually energized by energizing means, for example, a pusher 86, in a direction to come in close contact to each other to secure smooth movement.

As shown in FIGS. 1 and 4, for example, a control motor 43 as an actuator is connected to the end of the rocker shaft 11. The rocker shaft 11 is driven, or rotated around the center of axle by the control motor 43. By this rotation of the rocker shaft 11, the control arm 72 can be varied from a substantially perpendicular posture shown in, for example, FIGS. 5 and 6 to a posture greatly tilted to the camshaft rotating direction shown in FIGS. 7 and 8.

The center rocker arm 35 is moved, that is, displaced in the direction intersecting with the axial direction of the shaft portion 11*c* from this change of posture of the control arm 72. That is, as shown in FIGS. 5 to 8, the position at which the follower rolling intake contact cam follower 36 and the intake cam 15 can be varied in the early injection directions or the late injection direction.

Because the rotary contact position is variable, the posture of the cam surface 49 of the swing cam 45 is varied too. That can simultaneously and continuously vary an opening and closing timing, a valve opening period, and a valve lift volume of the intake valve 5.

Specifically, a curvature which varies the distance from the center of, for example, the support shaft 13 is used for the cam surface 49. As shown in FIG. 2, the cam surface 49 has a base circular zone α and a lift zone β. The circular zone α is the upper side of the cam surface 49. The base circular zone α is a circular arc surface centering around the center of axle of the support shaft 13.

The lift zone β is the lower side part of the cam surface 49. The lift zone β has a first portion γ1 and a second portion γ2. The first portion γ1 extends from the base circular zone α and curves the opposite direction opposite to the direction in which base circular zone α curves. The second portion γ2 extends from the first portion γ1. The second portion γ2 curves in the opposite direction opposite to the direction in which the first portion γ1 curves. Specifically, the base lift zone β is a circular arc surface similar to a cam shape of a lift area of, for example, the intake cam 15.

The oscillating range of the swing cam 45 is varied when rotary contact position where the cam follower 36 rotary contacts the intake cam 15 is displaced in the early or late injection direction of the intake cam 15. When the oscillating range of the swing cam 45 is varied, the region of the cam surface 49 with which the roller member 30 comes in contact is varied. More specifically, it is intended that the ratio of the base circular zone α and the lift zone β where the roller member 30 comes and goes is varied while the phase of the intake cam 15 is shifted to the early injection direction or late injection direction.

To the adjusting unit 80, a structure to support the end of the inserted control arm 72 by a screw member 82 is adopted as shown in, for example, FIGS. 2 to 4. Specifically, the screw member 82 is screwed from a point that is opposite to through hole 73 in the shaft portion 11*c* in such a manner as to freely advance and retreat. That is, the screw member 82 is screwed from upper peripheral wall of the shaft portion 11*c*. The insertion end of the screw member 82 impinges against the end of the control arm 72 halfway in the passage 73 and supports the control arm 72.

As a consequence, operating to rotate the screw member 81 varies the protrusion rate of the rod portion 74 protruding from the shaft member 11*c*. The volume of the protruding portion of the rod portion 74 is varied. When the protrusion rate of the rod portion 74 is varied, the rotary contact position of the cam follower 36 with which the intake cam 15 comes in contact is varied. On the basis of the changes of the rotary contact position of the cam follower 36 with which the intake cam 15 comes in contact with, valve opening time and the valve closing time of the intake valve 5 are adjusted.

Reference numeral 83 denotes, for example, a cruciform groove formed on the top end surface of the screw member 82 to operate to rotate the screw member 82. Reference numeral 84 denotes a lock nut driven into the end of the screw member 82. Reference numeral 84*a* denotes a notch which forms a bearing surface of the lock nut 84.

With reference to FIGS. 5 to 8, discussion will be made on the operation of the variable valve apparatus 20 obtained by the configuration described above. Now, assume that the camshaft 10 is rotated by the operation of an engine as shown in the arrow mark direction of FIG. 2.

In this case, the cam follower 36 of the center rocker arm 35 contacts the intake cam 15 and is tracer-driven by the cam profile of the cam 15. By this, the center rocker arm 35 oscillates in the vertical direction with the pin 42 set as the oscillating fulcrum.

The receiving surface 53*a* of the swing cam 45 is transmitted the oscillation displacement of the center rocker arm 35 through the gradient surface 40. Now, since the receiving surface 53*a* and the gradient surface 40 are slidable, the swing cam 45 repeats oscillating movement of being pressed up or lowered by the gradient surface 40 while sliding on the gradient surface 40. Oscillation of the swing cam 45 allows the cam surface 49 to reciprocate in the vertical direction.

Because, in this case, the cam surface 49 is rotatably in contact with the roller member 30 of the rocker arm 25, the roller member 30 is periodically pressed by the cam surface 49. The rocker arm 25 oscillates when pressure is applied thereto, and opens or closes the pair of intake valves 5, with the rocker shaft 11 as a support point.

Now, assume that the engine is operated at a high speed by operation of an accelerator pedal. After the motor 43 as a actuator receives acceleration signal, the motor 43 rotates the rocker shaft 11 and rotates the control arm 72 to the spot where, for example, the maximum valve lift volume is secured, for example, where the control arm 72 achieves the vertical posture as shown in FIGS. 5 and 6.

Then, the center rocker arm 35 displaces along the rotating direction on the intake cam 15 in response to the rotation of the control arm 72. As a consequence, the position where the center rocker arm 35 comes in rotary contact with the intake cam 15 is deviated in the early or late injection direction on the intake cam 15. Therefore the cam face 49 of the swing cam 45 fixed to the position where the cam surface 49 of the swing cam 45 achieves an angle close to perpendicularity as shown in FIGS. 5 and 6.

Figure 5:
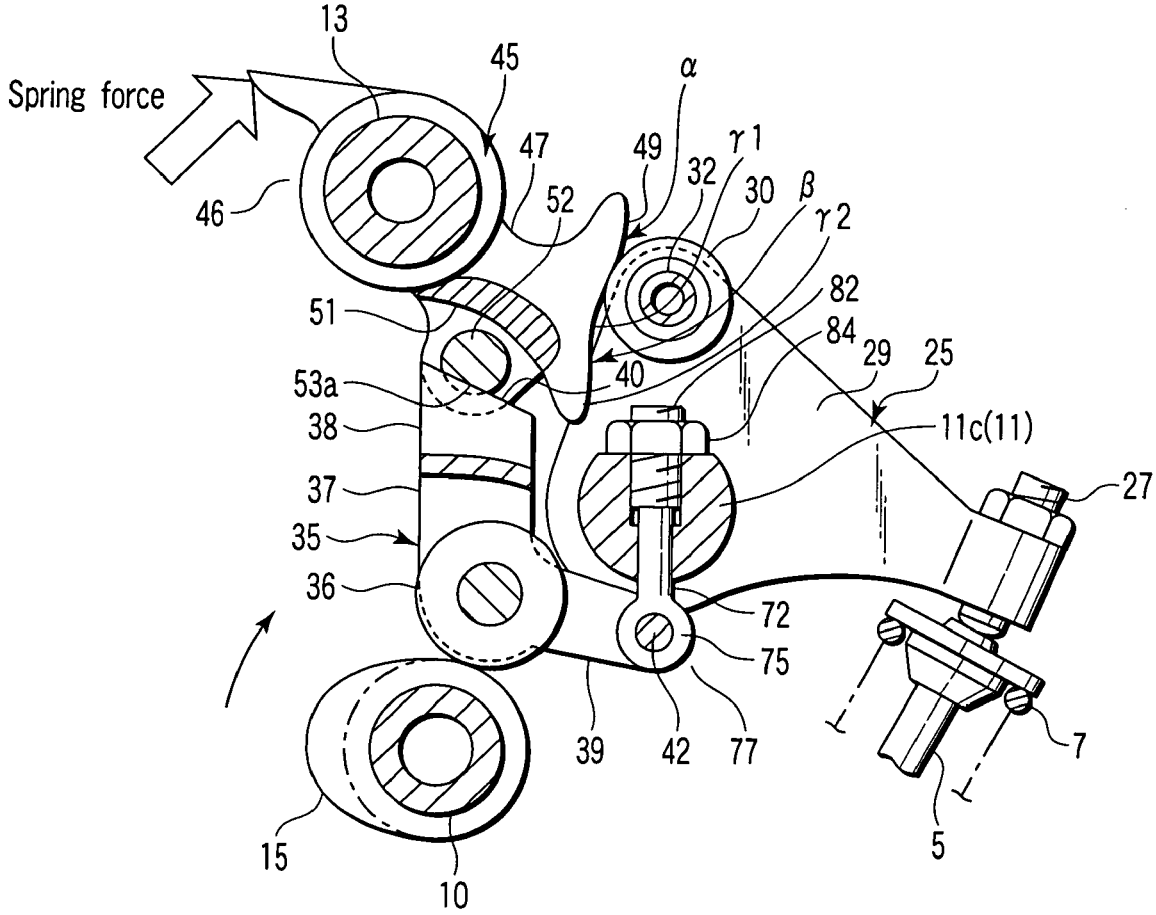
FIG. 5 is a cross sectional view showing a state where a rocker arm contacts a base circular zone of a cam surface at the maximum valve lift control of the variable valve apparatus shown in FIG. 2.
Figure 6:
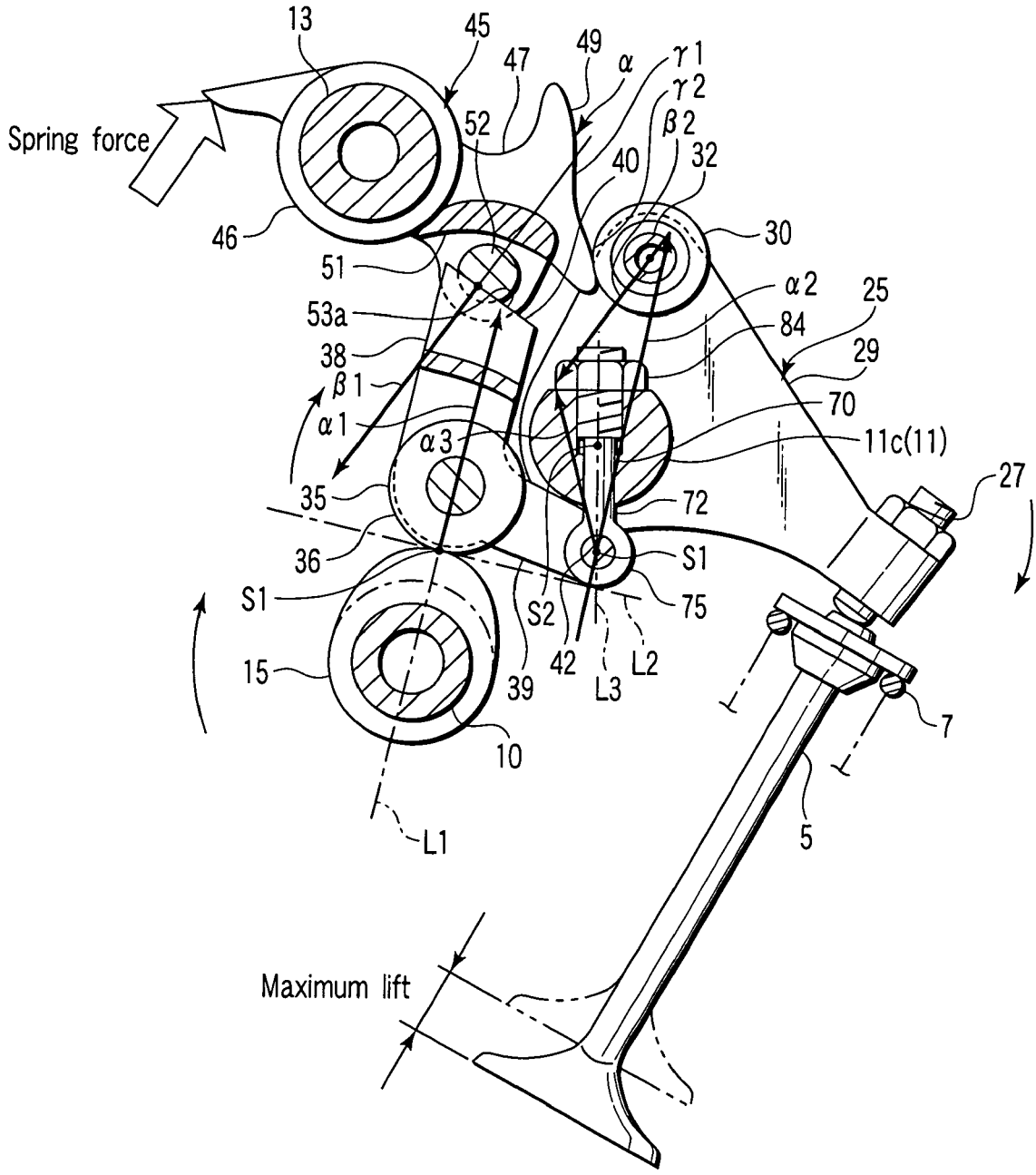
FIG. 6 is a cross sectional view of the variable valve apparatus, showing the rocker arm contacting the base circular zone also showing a valve driving force and a force working on a transmission arm in the at the maximum valve lift control.

By the posture of the cam surface 49, a region where the roller member 30 of the cam surface 49 comes and goes as shown in FIGS. 5 and 6 is set to a region which brings the maximum valve lift volume, that is, to the shortest base circular zone α and the longest lift zone β. That is, the rocker arm 25 is driven by the cam surface portion made by the narrow base circular zone α and the longest lift zone β. Consequently, the intake valve 5 is opened and closed at the maximum valve lift volume as shown in the graph of A1 of, for example, FIG. 9, and further, at an opening and closing timing that follows the intake stroke.

Figure 7:
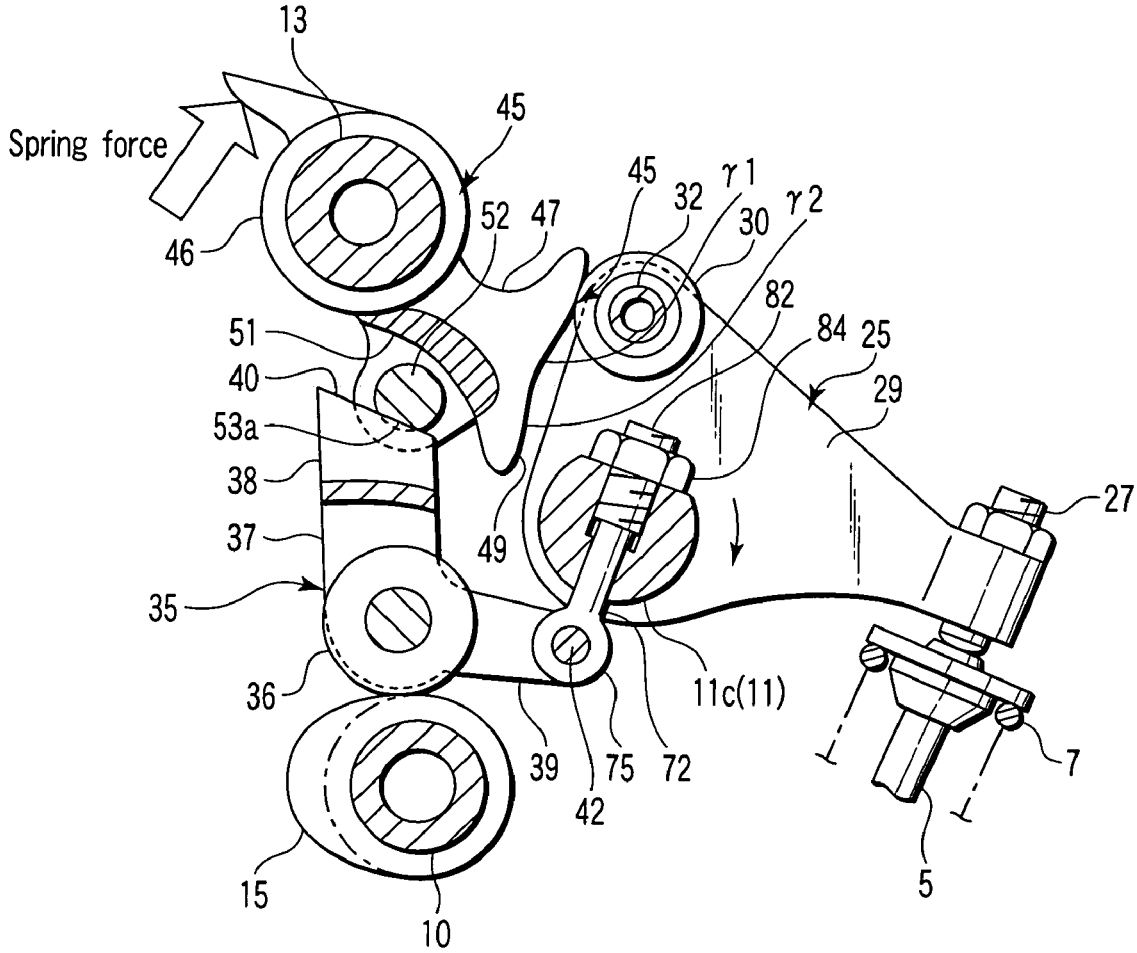
FIG. 7 is a cross sectional view showing a state where the rocker arm contacts the base circular zone of the cam surface at the minimum valve lift control of the variable valve apparatus shown in FIG. 2.
Figure 8:
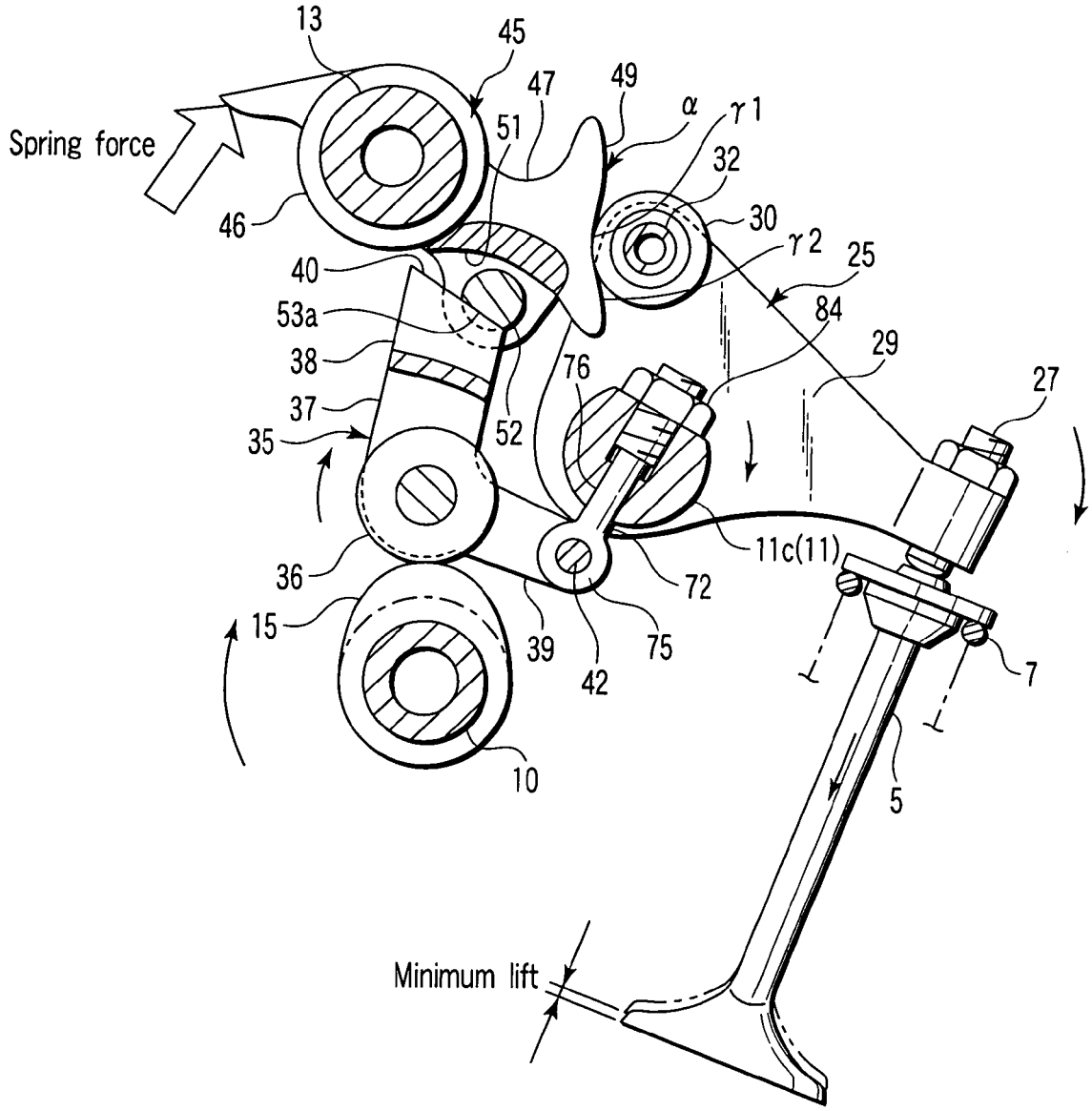
FIG. 8 is a cross sectional view showing a state where the rocker arm contacts a lift zone of the cam surface at the minimum valve lift control of the variable valve apparatus shown in FIG. 2.

In addition, when low and medium rotating operations are carried out, the drive of the control motor 43 rotates the rocker shaft 11 in the direction in which the pin 42 close to the intake cam 15 as shown in FIGS. 7 and 8. Then, in response to the rotation of the rocker shaft 11, the center rocker arm 35 moves on the intake cam 15 to the front side of the rotating direction. As a result, the rotary contact position between the center rocker arm 35 and the intake cam 15 is deviated in the early injection direction on the intake cam 15 as shown in FIGS. 7 and 8. By the change of this rotary contact position, the valve opening time of the cam phase is quickened. In addition, the gradient surface 40 slides from the initial position to the early injection direction on the receiving surface 53*a* in response to the shift of the center rocker arm 35.

By the shift of the center rocker arm 35 in this case, the swing cam 45 changes the posture to have the cam surface 49 tilted to the down side as shown in FIGS. 7 and 8. As the gradient increases, the region of the cam surface 49 in which the roller member 30 comes and goes is changed to a region in which the base circular zone α gradually increases and the lift zone β gradually decreases.

As the cam profile of the varied cam surface 49 is being transmitted to the roller member 30, the rocker arm 25 is oscillatably driven while the valve opening time is quickened.

Figure 9:
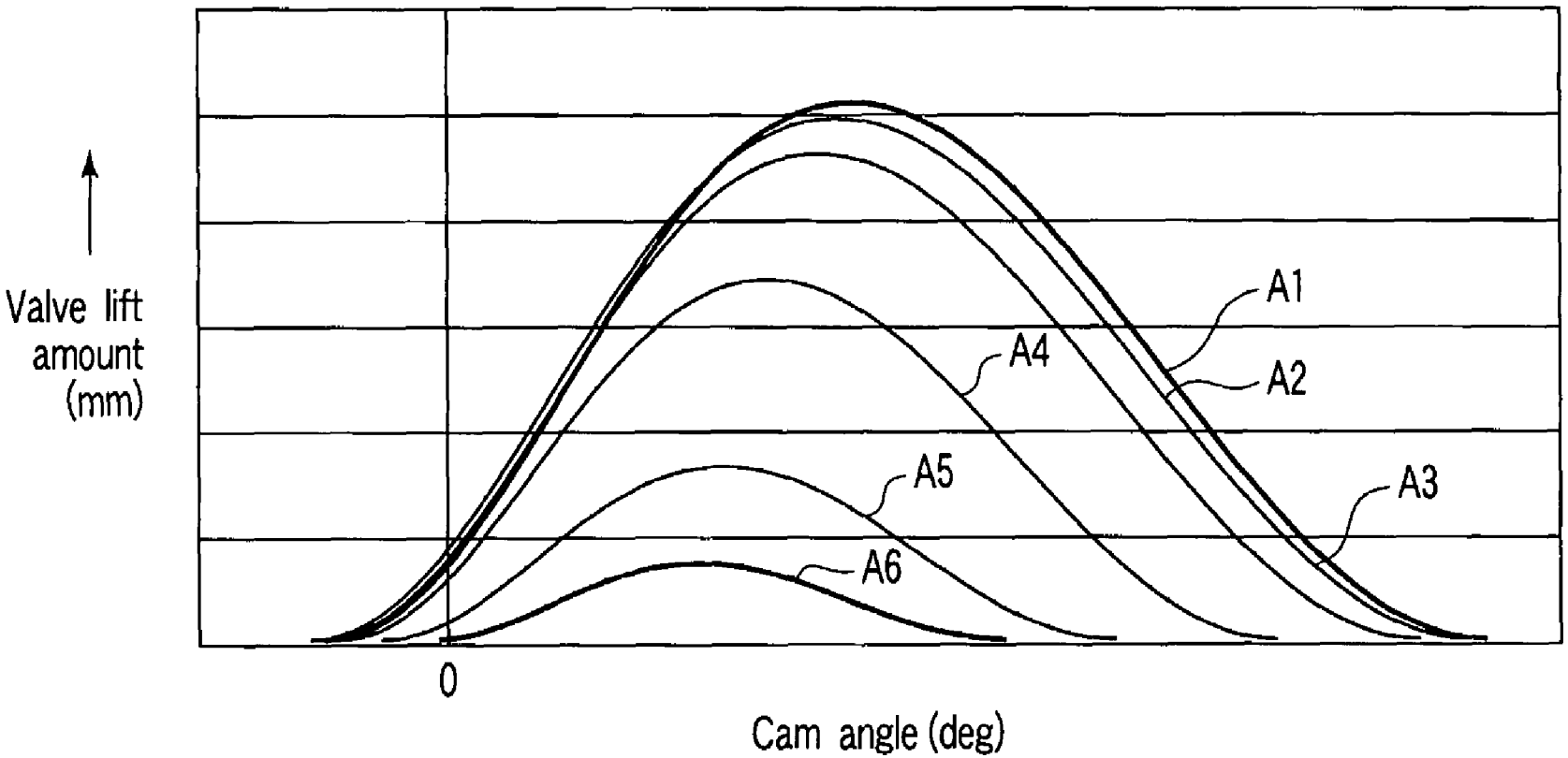
FIG. 9 is a graph showing performances of the variable valve apparatus shown in FIG. 2.

Accordingly, the intake valve 5 is controlled from the maximum valve lift volume A1 shown in, for example, FIG. 9 to the minimum valve lift volume A6 at the spot where the control arm 72 is tilted to the maximum. That is, the intake valve 5 holds the timing to open the valve substantially same at the maximum valve lift period from the high rotating operation to low rotating operation of the engine. The valve lift volume is continuously varied with varying the valve-close timing greatly while being the low valve lift volume. Needless to say, the engine 100 is 4 cylinders engine, and the rocker shaft 11, that is, control shaft is used in common among cylinders. Thus, this kind of variation of characteristics of the intake valve 5 takes place in all the cylinders 1*a*.

For the rocker shaft 11 and the center rocker arm 35 that vary valve phases as described above, contrivance is made to reduce burdens of the load working onto these components.

Figure 10:
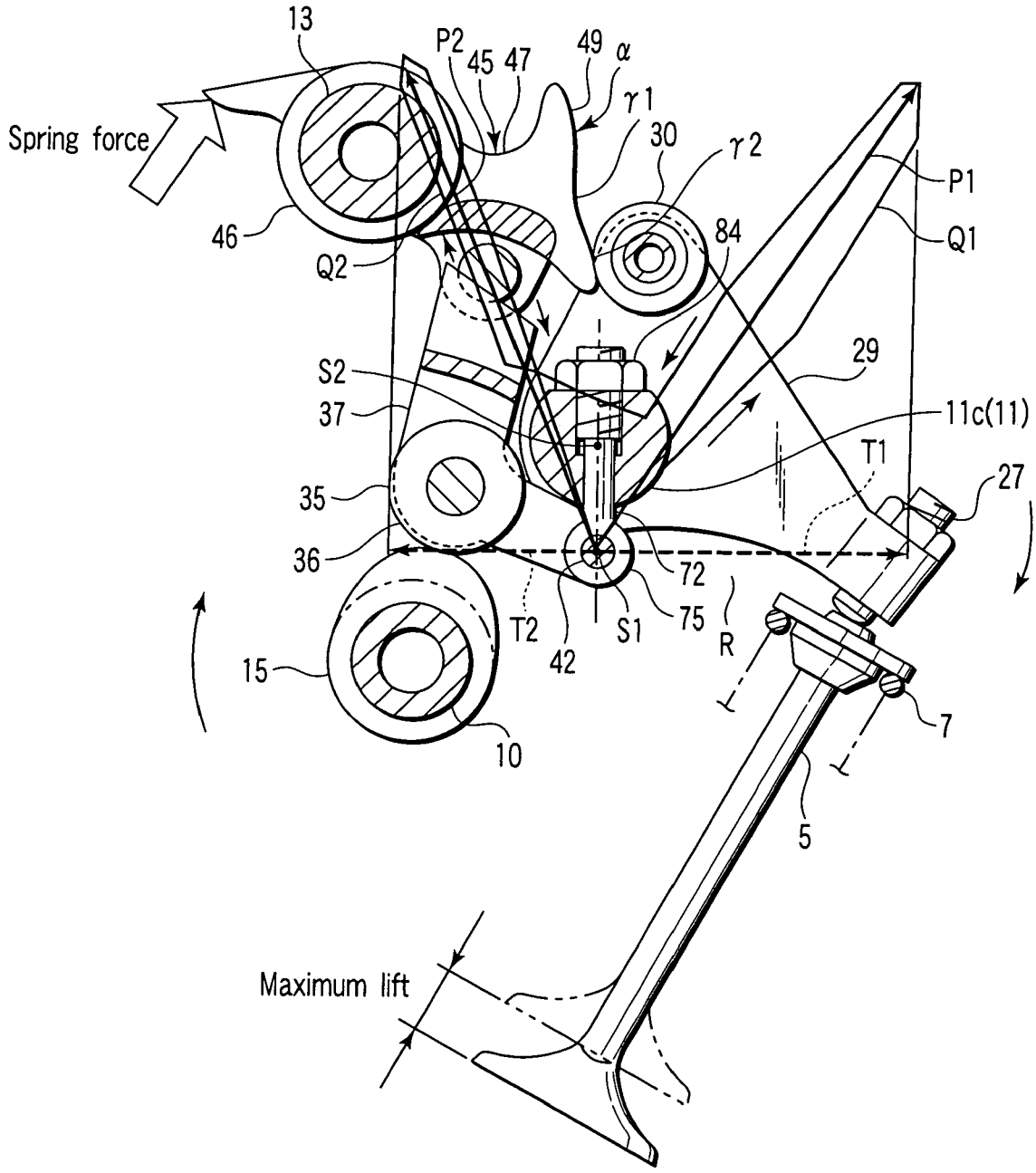
FIG. 10 is a view for explaining behaviors of a load working onto an oscillating fulcrum of the transmission arm at a high valve lift and high speed operation of the first embodiment.

To this contrivance, a technique is employed in which, as shown in FIG. 10, at the high valve lift and high speed operation of the engine, the maximum load at the time of opening the valve, and the maximum load at the time of closing the valve are made to work alternately on the rocker shaft 11 and the oscillating fulcrum S1, that is, oscillation center of the center rocker arm 35. Note that A1 and around it in FIG. 9 show the characteristics of the engine which is in the high valve lift and high speed operation.

For this technique, a structure is employed in which, at the high valve lift and high speed operation as shown in FIG. 6, a direction of the load, that is, direction of α3 working onto the oscillating fulcrum S1 of the center rocker arm 35 near the maximum lift is arranged substantially in parallel with a line L3 which connects the oscillating fulcrum S1 and a center S2 of the rocker shaft 11, that is, control shaft.

Note that α3 in FIG. 6 is a load that works onto the oscillating fulcrum S1 of the center rocker arm 35 at the moment of the maximum lift. α3 is the resultant force of a load α1 occurring in a normal direction L1 of the surface where the intake cam 15 and the center rocker arm 35 contact and a load β1 occurring in a normal direction of the surface where contacts the center rocker arm 35 and the swing cam 45.

The direction and the size of the load α3 change continuously while the swing cam 45 oscillates. At the high valve lift and high speed operation as shown in FIG. 10, the load occurring in the oscillating fulcrum, that is, trace of the load α3 in FIG. 6 changes from Q1 to Q2 when the swing cam 45 oscillates in association with the lift of the intake cam 15.

When the swing cam 45 rotates in the valve opening direction, the maximum load works on the oscillating fulcrum S1 from the rotation center S2 of the rocker shaft 11 to one side, that is, right side as shown by the trace Q1.

When the swing cam 45 rotates in the valve closing direction a load works on the oscillating fulcrum S1 from a rotation center S2 of the rocker shaft 11 to the other side, that is, left side as shown by the trace Q2.

The oscillating fulcrum S1 of the center rocker arm 35 and the rotation center S2 of the rocker shaft 11 are arranged at the area between the direction T1 of a component rotating the rocker shaft 11 of a maximum load P1 brought by the trace Q1, that is, maximum load occurring in the oscillating fulcrum S1 when the swing cam 45 rotates in the valve opening direction, and the direction T2 of a component rotating the rocker shaft 11 of a maximum load P2 brought by the trace Q2, that is, a maximum load occurring in the oscillating fulcrum S1, namely, an alternate area R shown in FIG. 10 where the load directions become reverse alternately to work alternately onto the oscillating fulcrum S1 at the high valve lift and high speed operation.

By this arrangement, not the resultant force of the load in the valve opening direction and the load in the valve closing direction, but one of the loads works onto the rocker shaft 11 alternately at the high valve lift and high speed operation. With the structure, a counterclockwise torque is made to occur in the rocker shaft 11 when the swing cam 45 rotates in the valve opening direction, a clockwise torque is made to occur in the rocker shaft 11 when the swing cam 45 rotates in the valve closing direction. Note that, the counter clockwise is assumed positive. Clockwise is assumed negative.

The oscillating fulcrum S1 and the rotation center S2 are arranged at a position where the load in the T1 direction where the maximum torque in the counterclockwise direction is generated to the rocker shaft 11, and the load in the T2 direction where the maximum torque in the clockwise direction is generated to the rocker shaft 11 are substantially same such that the torques work to the rocker shaft 11 become substantially equal in the clockwise direction and the counterclockwise direction at the high valve lift and high speed operation.

Further, in order that positive and negative torques per cylinder occurring in the rocker shaft 11 should be offset on the common rocker shaft 11, the oscillating fulcrum S1 of the center rocker arm 35 at the high valve lift and high speed operation is arranged in a position where the direction of the torque of the rocker shaft 11 occurring when the swing cam 45 of the next cylinder oscillates in the valve opening direction becomes reverse with respect to the torque of the rocker shaft 11 occurring when the swing cam 45 of the current cylinder oscillates in the valve closing direction.

Figure 11:
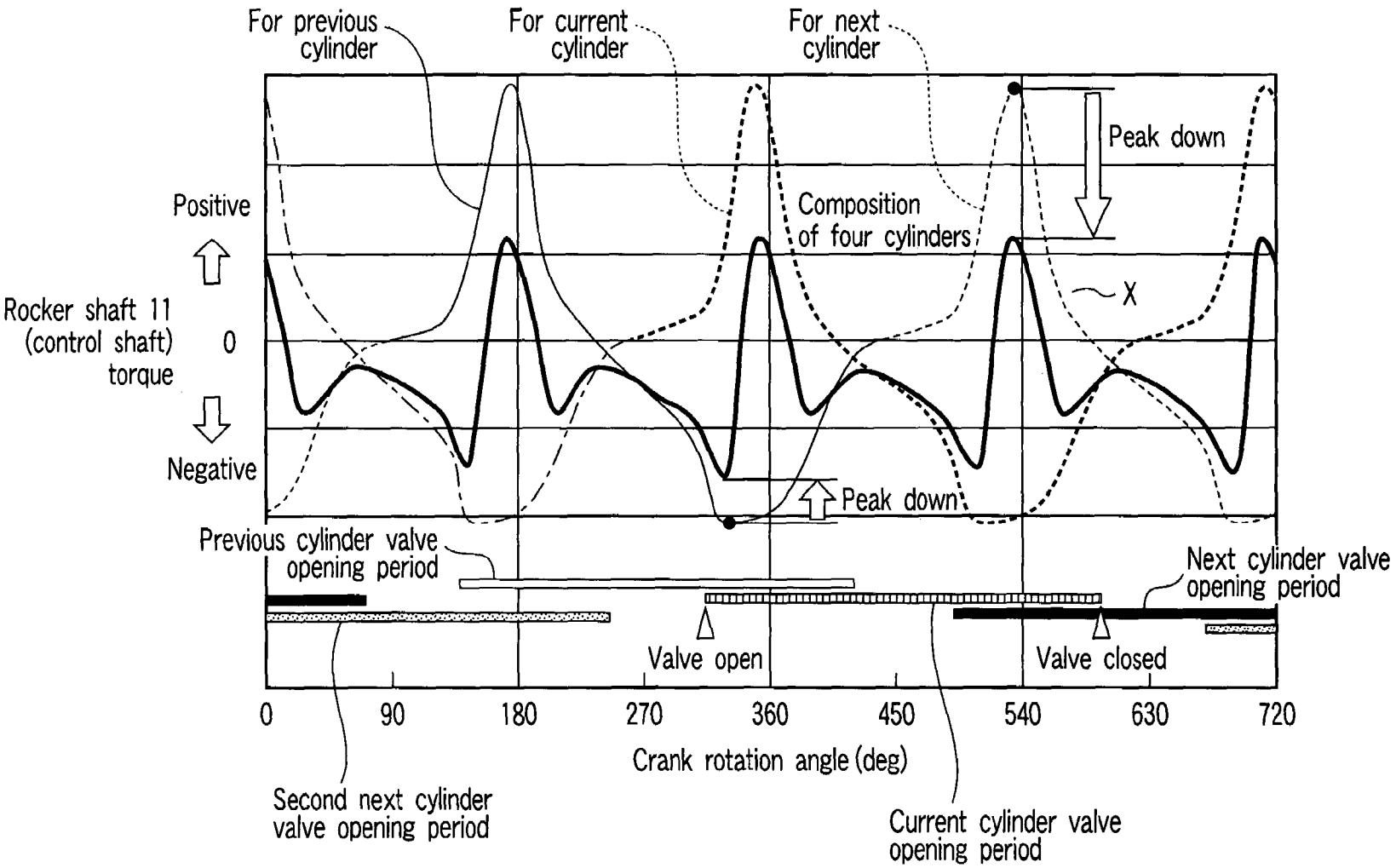
FIG. 11 is a graph showing torques that occurs on a control shaft of the first embodiment.

Further, as shown in FIG. 11, at the high valve lift and high speed operation, the oscillating fulcrum S1 of the center rocker arm 35 is arranged such that the valve of the next cylinder opens, that is, next cylinder starts the valve opening operation earlier than the timing to generate the maximum load which occurs in the oscillating fulcrum S1 of the current cylinder when the swing cam 45 oscillates in the valve closing direction, or the valve of the current cylinder closes, that is, current cylinder ends the valve closing operation later than the timing to generate the maximum load which occurs when the swing cam 45 of the next cylinder oscillates in the valve opening direction.

At the high valve lift and high speed operation in which valve characteristics near A1 and A2 in FIG. 9, the position of the rotation center S2 of the rocker shaft 11 to the oscillating fulcrum S1 of the center rocker arm 35 is arranged so that the component rotating the rocker shaft of the maximum lad P1 occurring at the time of opening the valve and the component rotating the rocker shaft 11 of the maximum load P2 occurring at the time of closing the valve are substantially offset.

Consequently, the maximum load in the direction T1 occurring on the rocker shaft 11 at the time of opening the valve and the maximum load in the direction T2 occurring on the rocker shaft 11 at the time of closing the valve can be set small, and as a result, the torque working onto the rocker shaft 11 can be set small.

Therefore, only by a simple arrangement and structure of the oscillating fulcrum S1 of the center rocker arm 35 and the rotation center S2 of the rocker shaft 11, it is possible to suppress the deformation under torsion of the rocker arm 11 caused by an excessive load. As a consequence, it is possible to reproduce the set valve characteristics, and to improve the engine output and improve the fuel consumption.

Further, because the burdens given to the oscillating fulcrum S1 of the center rocker arm 35 and the rocker shaft 11, that is, control shaft are suppressed, it is needless to use highly rigid members or components to the oscillating fulcrum S1 and the rocker shaft 11, and it is possible to make compact the peripheral area of the shaft 11 including the rocker shaft 11.

Furthermore, the actuator for rotating the rocker shaft 11, herein, the control motor 43 have only to be a motor capable of generating a torque enough to overcome the larger torque component of the loads P1, P2, and it is possible to attain the purpose with a small motor.

Moreover, the maximum loads P1, P2 work as loads of bending, etc. to the rocker shaft 11 and the supporting mechanism 70 in particular, the control arm 72. However, the position of the rotation center S2 of the rocker shaft 11 is arranged so that the component rotating the rocker shaft 11 of the maximum load P1 occurring at the time of opening the valve and the component rotating the rocker shaft 11 of the maximum load P2 occurring at the time of closing the valve are substantially offset. Thereby, it is possible to make the cross sectional shape of the rocker shaft 11 substantially symmetrical to L3 connecting S1 and S2.

Consequently, cross sectional shape of the rocker shaft 11 can be compact by making the most suitable shape adapted for both of the maximum loads P1, P2. Moreover, also with regard to the control arm 72 in the same manner, the bending load can be set minimum, so that it is possible to prevent the lift changes owing to deflection and fretting wear of the holding portions, and perform a compact design.

In particular, a structure is employed in which the variable valve apparatus 20 is driven per cylinder by use of the common rocker shaft 11, that is, control shaft. In this case, as shown in FIG. 10, the oscillating fulcrum S1 of the center rocker arm 35 is arranged in the position where the direction of the torque of the rocker shaft 11 occurring when the swing cam 45 of the next cylinder oscillates in the valve opening direction becomes reverse with respect to the torque of the rocker shaft 11 occurring when the swing cam 45 of the current cylinder oscillates in the valve closing direction.

For this reason, as shown in FIG. 11, with regard to the positive and negative torques, that is, clockwise and counterclockwise torques occurring in the rocker shaft 11, the torque for the previous cylinder shown in a thin line as shown in FIG. 11, the torque for the current cylinder shown in a broken line, and the torque of the next cylinder shown in a thin broken line are offset mutually.

Therefore, with regard to the torque on the rocker shaft 11, there occurs only a torque whose torque peak is low as shown in the torque shown in a thick line in FIG. 11, and whose average torque value is small. Accordingly, the burdens to the rocker shaft 11, that is, burdens to the control shaft and the control motor 43 are small even in a multi-cylinder engine.

Moreover, as shown in FIG. 11, the valve of the next cylinder is set in order to close earlier than the timing to generate the maximum load of the rocker shaft 11 occurring when the valve of the current cylinder closes, or the valve of the current cylinder is set in order to close the valve later than the timing to generate the maximum load occurring when the valve of the next cylinder opens. Consequently, it is possible to effectively reduce the maximum values of respective loads such as the maximum load for the previous cylinder, the maximum load for the current cylinder, and the maximum load for the next cylinder, and thus, the burdens to the rocker shaft 11, that is, control shaft and the control motor 43 can be made further smaller.

A load direction which works onto the oscillating fulcrum S1 of the center rocker arm 35 when the intake valve 5 is near its maximum lift, and a line which connects the oscillating fulcrum S1 of the center rocker arm 35 and the rotation center S2 of the rocker shaft 11 are substantially in parallel with each other. In this structure, at the high valve lift and high speed operation, the rotation center of the rocker shaft 11 and the oscillating fulcrum S1 of the center rocker arm 35 are easily arranged between a direction of a component rotating the rocker shaft lit of a load which occurs in the oscillating fulcrum S1 of the center rocker arm 35 when the oscillating cam 45 oscillates in a valve opening direction and a direction of a component rotating the rocker shaft 11 of a load opposite thereto which occurs when the oscillating cam 45 oscillates in a valve closing direction.

Now, with reference to FIGS. 12 and 13, a variable valve apparatus according to a second embodiment of the present invention will be described. Note that the configurations having the same functions as those in the first embodiment are denoted by the same reference numerals and the description thereof is not repeated.

In the present embodiment, it is difference that the variable valve apparatus 20 is provided at the exhaust side. Other structures may be the same as those in the first embodiment. The difference will be described in detail.

Figure 12:
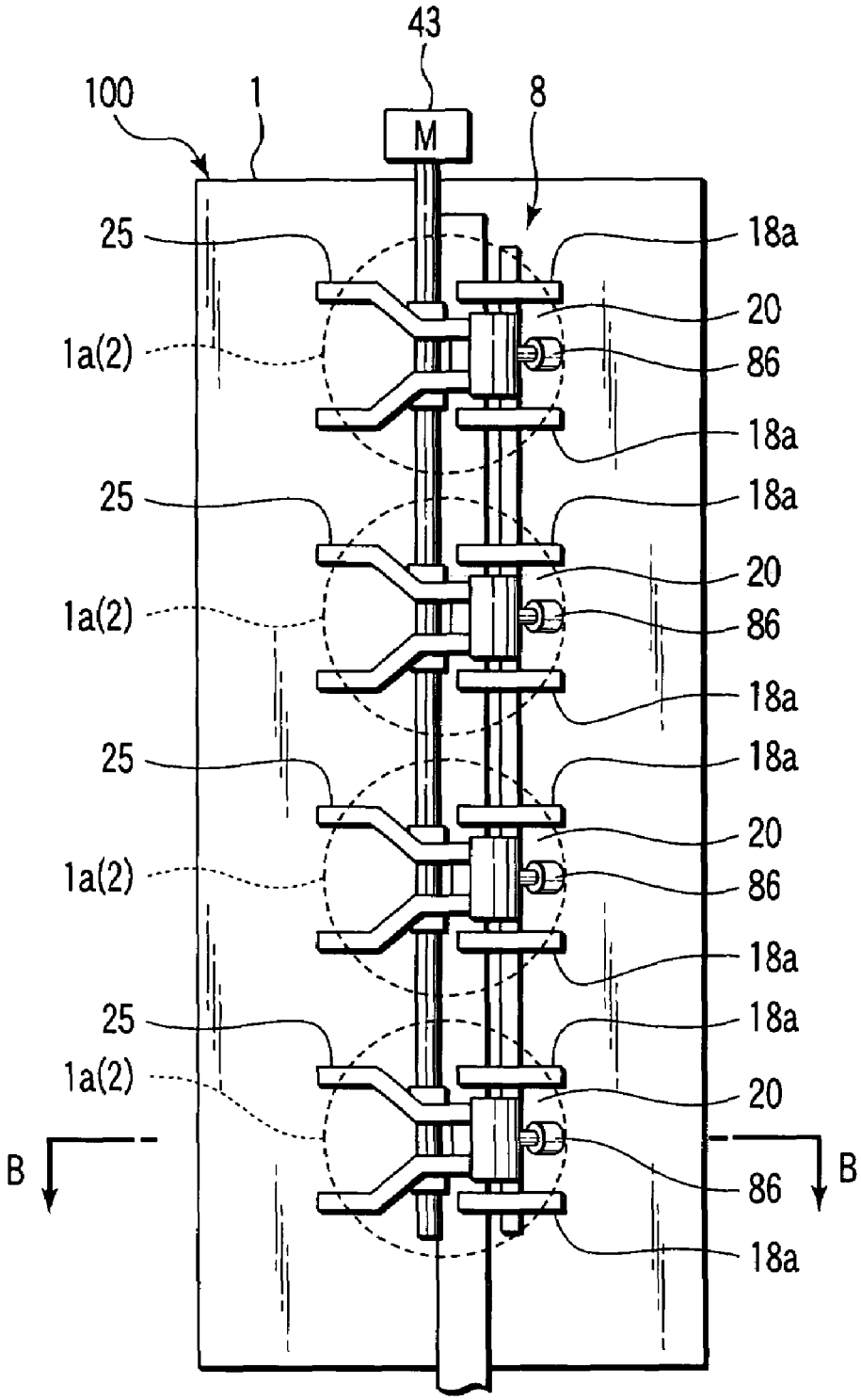
FIG. 12 is a plan view showing a cylinder head having, mounted on it, a variable valve apparatus according to a second embodiment of a present invention.

FIG. 12 is a plan view of a cylinder head 1 mounted the variable valve apparatus 20 according to this embodiment. FIG. 13 is a cross sectional view taken along line B—B shown in FIG. 12 the cylinder head 1.

Figure 13:
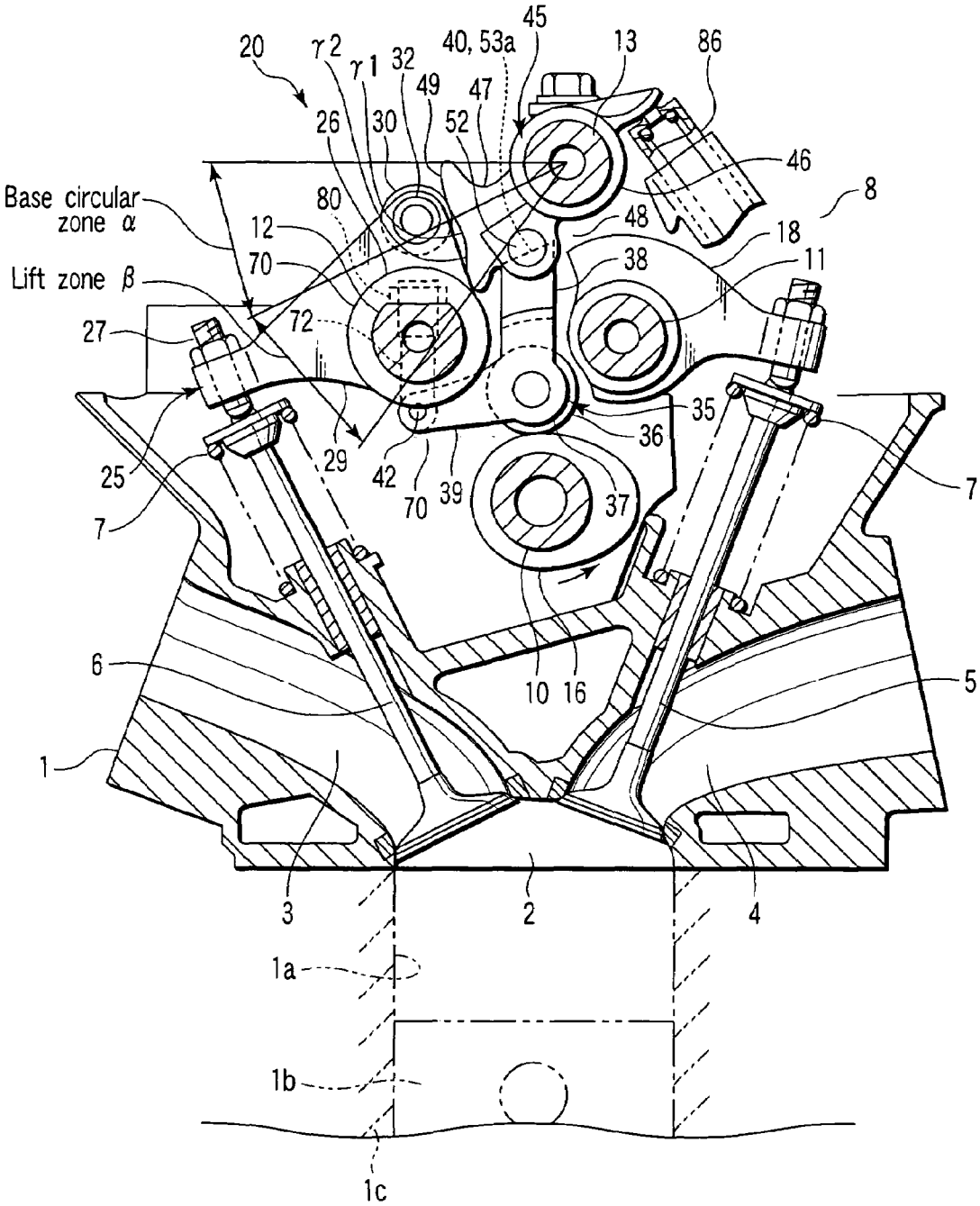
FIG. 13 is a cross sectional view taken along line B—B in FIG. 12 showing the variable valve apparatus and the cylinder head.

As shown in FIGS. 12 and 13, rocker shaft 12 of the exhaust side is provided the variable valve apparatus 20 per the pair of the exhaust cam 16, that is, the pair of the exhaust valve 6. The a rocker arm 18*a* for the intake is rotatably supported by the rocker shaft 11 of the intake valve 15 per intake cam 15, that is intake valve 15. The present embodiment can also provides the same advantageous effects as those provided by the first embodiment.

Note that the present invention is not limited to the first and second embodiments described above, and the present invention may be embodied in other specific forms without departing from the spirit or essential characteristics thereof. For example, in the above embodiment, the structure is employed in which the rocker shaft at the intake side is used also as the control shaft. However, a structure may be made in which a control shaft is employed separately.

Furthermore, in the first and second embodiments, the present invention is applied to an engine of an SOHC type valve operating system. A structure where the intake valve and the exhaust valve are driven by one camshaft is used for the SOHC type valve operating system. However, the present invention is not limited thereto, and the present invention may be applied to an engine of a Double Overhead Camshaft (DOHC) type valve operating system. A structure having a camshaft exclusive for the intake side and another camshaft exclusive for the exhaust side is used for the DOHC type valve operating system.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A variable valve apparatus of an internal combustion engine, comprising:

a camshaft provided rotatably in the internal combustion engine;

a cam formed on the camshaft;

an oscillating cam provided oscillatably in the internal combustion engine, and having a cam surface which drives an intake valve or an exhaust valve;

a transmission arm which is interposed between the oscillating cam and the cam, and which transmits the displacement of the cam to the oscillating cam; and a control shaft which is configured to change a position where the transmission arm comes into contact with the cam by rotation displacement, and which controls valve characteristics of the intake valve or the exhaust valve by the position change, the control shaft being provided rotatably in the internal combustion engine and supporting the transmission arm oscillatably, an oscillating fulcrum of the transmission arm and a rotation center of the control shaft being, at a high valve lift and high speed operation of the internal combustion engine, arranged between a direction of a component rotating the control shaft of a maximum load which is applied at the oscillating fulcrum of the transmission arm when the oscillating cam oscillates in a valve opening direction, and a direction of a component rotating the control shaft of a maximum load opposite thereto, said maximum load being applied at the oscillating fulcrum of the transmission arm when the oscillating cam oscillates in a valve closing direction.

2. A variable valve apparatus of an internal combustion engine, according to claim 1, wherein a load direction which works onto the oscillating fulcrum of the transmission arm when the intake valve or the exhaust valve is near its maximum lift, and a line which connects the oscillating fulcrum of the transmission arm and the rotation center of the control shaft are substantially in parallel with each other.

3. A variable valve apparatus of an internal combustion engine, according to claim 2, wherein the internal combustion engine has a plurality of cylinders, the oscillating cam and the transmission arm are arranged for each cylinder of the internal combustion engine, the control shaft is configured by a common shaft component which supports oscillatably transmission arms of at least two cylinders, respectively, and the oscillating fulcrum of the transmission arm is arranged in a position in which a direction of a torque of the control shaft which occurs when the oscillating cam of the next cylinder oscillates in the valve opening direction becomes reverse to a torque of the control shaft which occurs when the oscillating cam of the current cylinder oscillates in the valve closing direction.

4. A variable valve apparatus of an internal combustion engine, according to claim 3, wherein the oscillating fulcrum of the transmission arm for each cylinder is set such that the next cylinder starts a valve opening operation thereof earlier than the timing to generate the maximum load which occurs in the oscillating fulcrum of the transmission arm of the current cylinder when the oscillating cam oscillates in the valve closing direction, or the current cylinder ends a valve closing operation thereof later than the timing at which there occurs the maximum load which occurs when the oscillating cam of the next cylinder oscillates in the valve opening direction.

5. A variable valve apparatus of an internal combustion engine, according to claim 1, wherein the internal combustion engine has a plurality of cylinders, the oscillating cam and the transmission arm are provided for each cylinder of the internal combustion engine, the control shaft is configured by a common shaft component which supports oscillatably transmission arms of at least two cylinders, respectively, and the oscillating fulcrum of the transmission arm is arranged in a position in which a direction of a torque of the control shaft which occurs when the oscillating cam of the next cylinder oscillates in the valve opening direction becomes reverse to a torque of the control shaft which occurs when the oscillating cam of the current cylinder oscillates in the valve closing direction.

6. A variable valve apparatus of an internal combustion engine, according to claim 5, wherein the oscillating fulcrum of the transmission arm for each cylinder is set such that the next cylinder starts a valve opening operation thereof earlier than the timing to generate the maximum load which occurs in the oscillating fulcrum of the transmission arm of the current cylinder when the oscillating cam oscillates in the valve closing direction, or the current cylinder ends a valve closing operation thereof later than the timing to generate the maximum load which occurs when the oscillating cam of the next cylinder oscillates in the valve opening direction.

* * * * *